United States Patent [19]

Schippers

[11] Patent Number: 4,774,042

[45] Date of Patent: Sep. 27, 1988

[54] METHOD FOR MAKING MULTI-FILAMENT YARN

[75] Inventor: Heinz Schippers, Remscheid, Fed. Rep. of Germany

[73] Assignee: Barmag AG, Remscheid, Fed. Rep. of Germany

[21] Appl. No.: 902,307

[22] Filed: Aug. 29, 1986

[30] Foreign Application Priority Data

Aug. 30, 1985 [DE] Fed. Rep. of Germany ..... 3531027

[51] Int. Cl.[4] ..... D01D 5/16

[52] U.S. Cl. ..... 264/103; 264/210.2; 264/210.5; 264/210.6; 264/210.7; 264/210.8; 264/211.14; 264/211.17; 264/211.22; 264/289.6; 264/290.5

[58] Field of Search ..... 264/211.12, 211.15, 264/211.14, 211.17, 235.6, 342 R, 342 RE, 290.7, 290.5, 103, 210.2, 210.6, 210.7, 210.8, 210.5, 289.6, 211.22

[56] References Cited

U.S. PATENT DOCUMENTS

| | | | |
|---|---|---|---|
| 3,039,171 | 6/1962 | Hume et al. | 264/342 RE |
| 3,199,281 | 8/1965 | Maerov et al. | 264/342 RE |
| 3,423,809 | 1/1969 | Schmitt | 264/211.15 |
| 3,705,225 | 12/1972 | Taylor | 264/342 RE |
| 4,185,064 | 1/1980 | Schippers | 264/342 R |

*Primary Examiner*—Jan H. Silbaugh

*Assistant Examiner*—Hubert C. Lorin

*Attorney, Agent, or Firm*—Bell, Seltzer, Park & Gibson

[57] ABSTRACT

A method is disclosed for melt spinning man-made filaments, and wherein the filaments are formed into yarn components which are subsequently combined to form a composite yarn. The method and apparatus include provision for selectively modifying the physical properties of the yarn components, so that the physical properties may be either the same or different from each other in the resulting composite yarn. In the illustrated embodiments, a polymer is extruded through a spinneret to form a plurality of separate groups of advancing filaments, and the physical properties of at least one of the groups is modified in relation to the physical properties of the other groups. The modification of the physical properties may be effected by drawing each of the groups so that all of the groups are subjected to the same total draw ratio, but with the drawing process being conducted in sequential steps which are different between at least two groups of filaments. The modification of the physical properties may also be effected by different heat treatments of the advancing groups of filaments in conjunction with the drawing step. Where different shrinkage properties are imparted to the yarn components, the resulting composite yarn may be subjected to a heat treatment, which serves to texturize the yarn by the shrinkage of the components having the greater shrinkage tendency.

12 Claims, 4 Drawing Sheets

METHOD FOR MAKING MULTI-FILAMENT YARN

BACKGROUND OF THE INVENTION

The present invention relates to a method and apparatus for melt spinning man-made filaments and continuously forming the same into a yarn. More particularly, the invention relates to a method and apparatus for making a composite yarn composed of a plurality of yarn components having different physical properties, such as shrinkage or texturizing characteristics.

In present processes involving the melt spinning, drawing, and plying of several yarn components to form a composite yarn, it is recognized that the components may be designed to have different physical properties. For example, it is possible to differently dye the raw polymeric material of the yarn components to produce a spin dyed composite yarn. However, the addition of the dye very often effects the chemical or physical properties of the yarn, and this may result in a disadvantage in that the components of the composite yarn exhibit for example, different strength-elongation properties and different shrinkage properties.

It is an object of the present invention to produce a composite yarn which may be composed of differently dyed yarn components, and with the other properties of the yarn components being related to each other in a desired manner. Thereby, the composite yarn may be prevented from undergoing an undesirable structural change during further processing, or when used, by reason of the different properties of the yarn components.

To produce a textured composite yarn, it is known that the yarn components can be made with different shrinkage properties and plied to form the composite yarn. The composite yarn is then subjected to a heat treatment operation, which results in the shrinkage of at least one of the components which in turn produces a texturizing effect in the composite yarn. Yarn components having different shrinkage properties have previously been prepared from components of a different origin, note for example U.S. Pat. No. 4,019,311, or the components may be from the same origin but drawn at different draw ratios. Producing the yarn components from different origins is disadvantageous, both economically and technically, since it is difficult to prevent the yarn components from having different wearing characteristics. Thus the life of the finished textile product is dependent on the life of the weakest component. Similar disadvantages are present in the production of a composite yarn from yarn components of the same origin but which are drawn at different ratios. Specifically, the drawing influences the denier of the yarn components in a significant manner, so that the components have different deniers. Further, the strength-elongation behavior is affected so that only one yarn component may be considered as a wearing component. If the slightly drawn component shows a greater shrinkage characteristic, this relatively weak component will form the limiting wear component of the composite yarn, i.e., the component which determines the physical properties. As a result, the composite yarn is inferior as far as its physical properties are concerned.

It is according a more specific object of the present invention to produce a composite yarn which can be texturized, and in which the yarn components are of the same origin, are simultaneously spun and drawn, and have the same denier and substantially identical strength-elongation properties, and yet have sufficiently different shrinkage properties to permit the texturizing of the composite yarn.

It is also known that so-called "spun-like" filament yarn can be produced from man-made continuous filaments, by breaking the filaments as part of an overdrawing process. Thus for example, yarn components may first be produced which have different breaking elongations, and these components are then plied and jointly drawn at a given draw ratio which is in the range of the breaking elongation of the component having the lowest breaking elongation properties. Here again however, it is disadvantageous to produce the yarn components from different origins, or to subject the yarn components from the same origin to different draw ratios. It is thus a further object of the present invention to produce a composite yarn wherein the components have the same denier, and also certain other similar physical properties, but wherein the breaking elongation properties of the filaments are different in the yarn components, so that a portion of the filaments can be broken in a subsequent drawing process without damaging the other portion of the filaments.

SUMMARY OF THE INVENTION

The above and other objects and advantages of the present invention are achieved in the embodiments illustrated herein by the provision of a method and apparatus for making a composite yarn composed of polymeric filaments, and which involves the steps of melt spinning polymeric material to form at least two separate groups of advancing filaments, modifying the physical properties of at least one of the groups of advancing filaments and so that the physical properties of one group of advancing filaments change with respect to the physical properties of another group of advancing filaments, and including drawing each of the groups of filaments so that all of the groups have the same total draw ratio. The groups of advancing filaments are then combined to form a composite yarn.

In a preferred embodiment, the groups of filaments are advanced along respective, generally parallel paths of travel extending downwardly from a spinning nozzle, and the drawing step includes drawing at least one of the groups of filaments in sequential steps along its path of travel, with the steps having different draw ratios, and such that the draw ratio applied to one of the groups of advancing filaments differs from the draw ratio applied to another of the groups of advancing filaments at corresponding locations along their paths of travel.

By way of a simple specific example, two yarn components may be drawn so as to have a total draw ratio of 1:6, and wherein one component is drawn in a first step at a ratio of 1:2 and in a second step at a ratio of 1:3, whereas the other yarn component is drawn in a first step at a ratio of 1:3 and in a second step at a ratio of 1:2.

The drawing operations preferably are conducted immediately below the spinning nozzle, since this will also lead to a partial orientation of the filaments. Also, the two yarn components may be spun so that the same quantity of polymeric material exits from the spin nozzle per unit of time. In one embodiment, the yarn components are withdrawn from the spin nozzle at different delivery speeds, and subjected to a final drawing, with the speed at the end of the final drawing being identical.

This results in yarns with the same denier, but different physical properties.

Another parameter which effects the physical properties is the temperature at which the yarn components leave the drawing zone. This temperature specifically influences the shrinkage properties, and an adjustment of this temperature can compensate for the different shrinkage properties which can occur, for example, when one of the yarn components is dyed, or has other additives, or where the difference in shrinkage properties is otherwise purposefully produced. In accordance with the present invention, the described parameters can be influenced so as to achieve the desired final properties of the composite yarn. The parameters may be adjusted so that the physical properties of the yarn components, such as the shrinkage properties, are identical to each other in cases where they are initially different, or the parameters may be adjusted to impart different physical properties to the different yarn components where they are initially the same. The latter procedure permits a particularly economical and technically simple process for spinning a plurality of filaments on the same spinning system, to combine these filaments to form two yarn components, and to draw the two yarn components at an identical total draw ratio and such that the individual filaments have an identical denier and identical strength-elongation properties. By conducting the drawing operation in steps which differ between the yarn components, one component may be provided with a greater shrinkage tendency than the other. After plying the components, a textured composite yarn may be produced by causing the shrinkage of such one component, such as by the application of heat.

In the above example, the drawing operation is preferably followed by a continuous shrinkage treatment, which occurs under little yarn tension. It is also possible to cause shrinkage in a stuffer box, into which the composite yarn advances directly after having been drawn. This results in that the stuffer box crimp is superposed with the crimp which is obtained by the different shrinkages of the two yarn components, i.e., the differential shrinkage crimp or texturization. A stuffer box suitable for use with the present invention is described, for example, in German patent No. 2632082 and corresponding U.S. Pat. No. 4,118,843.

BRIEF DESCRIPTION OF THE DRAWINGS

Some of the objects and advantages of the present invention having been stated, others will appear as the description proceeds when taken in conjunction with the accompanying drawings, in which·

DETAILED DESCRIPTION OF THE PREFERRED EMBODIMENTS

Figure 1:
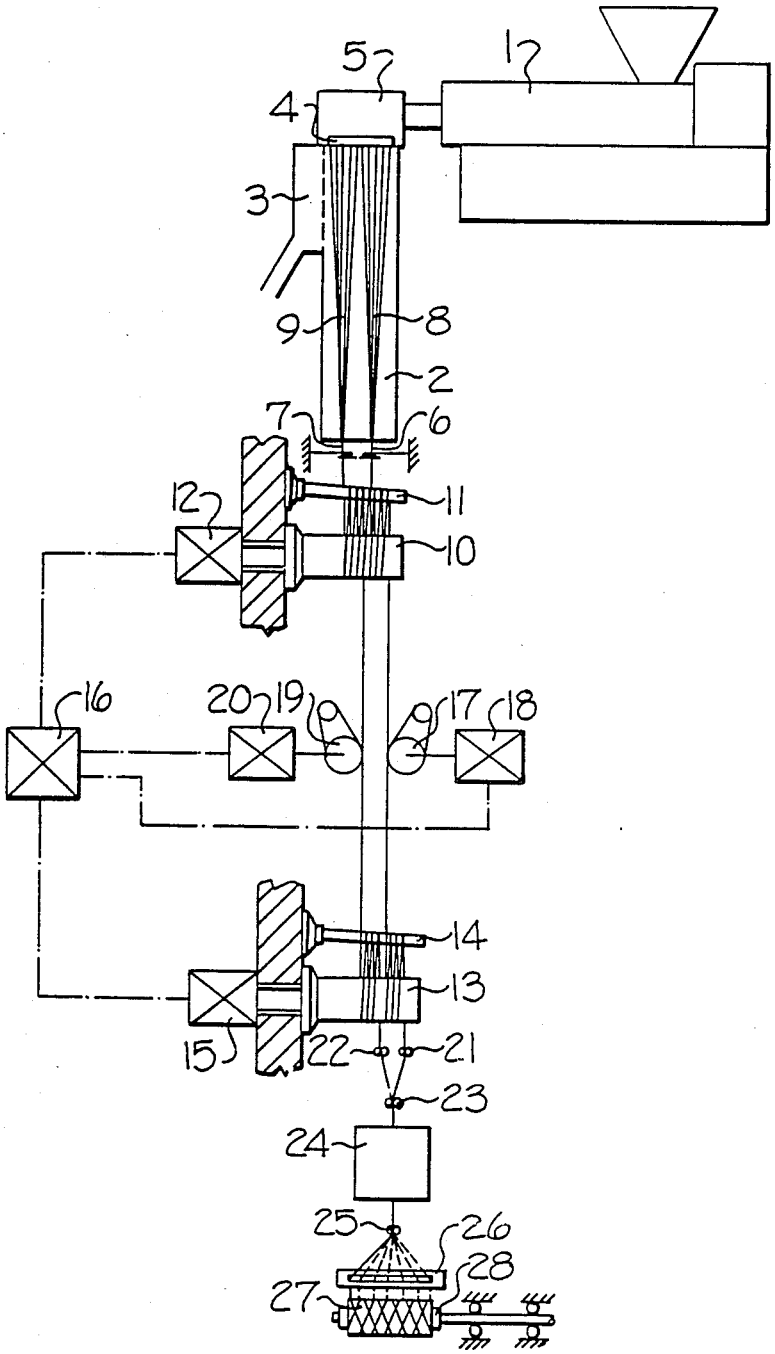
FIG. 1 is a schematic view of a melt spinning apparatus which embodies the features of the present invention.

Referring more particularly to the embodiment illustrated in FIG. 1, there is disclosed an apparatus for melt spinning man-made filaments and continuously forming the same into a yarn, and which includes an extruder 1 for melting and extruding a suitable polymeric material, such as polyester, polyamide 6, polyamide 6.6, or polypropylene. The polymer is extruded through a spinning nozzle 4 of the spin head 5 to form a plurality of filaments, which are guided to form two separate groups 8, 9 of advancing filaments. The groups 8, 9 are combined to form yarn components 6, 7 respectively, and the filaments are cooled in the cooling chamber 2 which is positioned immediately below the spinning nozzle 4 and wherein the filaments are cooled by an air blowing system 3. The two yarn components 6 and 7 both advance to the delivery roll 10, which serves to withdraw the filaments from the spinning nozzle 4. The delivery roll 10 has an associated guide roll 11, and the yarn components loop several times around the rolls 10 and 11 without contacting each other. A motor 12 drives the delivery roll 10, from which the yarn components 6 and 7 advance respectively to the draw rolls 17 and 19, which are respectively driven by the motors 18 and 20.

A downstream draw roll 13, which is common for both of the yarn components 6 and 7, withdraws the components from their respective draw rolls 17 and 19. Also, a cooperating guide roll 14 precedes the draw roll 13, so that the yarns can be looped around the rolls 13 and 14 several times without contacting each other. A motor 15 is provided for driving the draw roll 13, and the motors 12 and 15 are interconnected via a control system 16, so that these two motors can be driven at a predetermined speed ratio. This speed ratio corresponds to the total draw ratio. Similarly, the motors 18 and 20 are controlled by the control system 16, so as to drive the draw rolls 17 and 19, and such that the speed of the rolls 17 and 19 may be separately adjusted. Thus the rolls 17 and 19 may have a selected ratio with respect to each other and also with respect to the draw rolls 10 and 13.

The yarn components 6 and 7 are then withdrawn from the draw roll 13 and passed through the yarn guides 21 and 22, and are combined to form a composite yarn, such as by plying at 23. Thereafter, the composite yarn may be moved through special treatment systems, such as for example, texturizing means, crimping means, wetting means, and air jet entangling means. Such treatment systems are indicated schematically at 24. The composite yarn is then reciprocated by a conventional yarn traversing system 26 which is positioned between a yarn guide 25 and a takeup package 27 which is positioned on a spindle 28. The spindle 28 is driven so that the surface speed of the package remains constant as the package diameter increases.

In the embodiment of FIG. 1, it may be assumed that the filaments are spun with uniiorm, identical physical properties and such that all of the filaments in the composite yarn have an identical denier which results from the total draw ratio. However, the fact that the draw rolls 17 and 19 can be driven at different speeds, permits the two yarn components 6 and 7 to have different draw ratios applied at corresponding locations along their path of travel through the drawing zone between the rolls 10 and 13. This in turn permits the shrinkage properties of the yarn components to be differently adjusted, and as a result, the filaments of one yarn component having the greater shrinkage tendency will contract to a greater degree in a subsequent shrinkage treatment than will the filaments of the other yarn component. The filaments of the component having the lesser shrinkage will form bows, loops, and curls in the composite yarn. Alternatively, the shrinkage can take place after the composite yarn is formed into a fabric, which has the advantage that the yarns have the physical properties of the composite yarn during formation into a fabric, such as by weaving or knitting.

Figure 2:
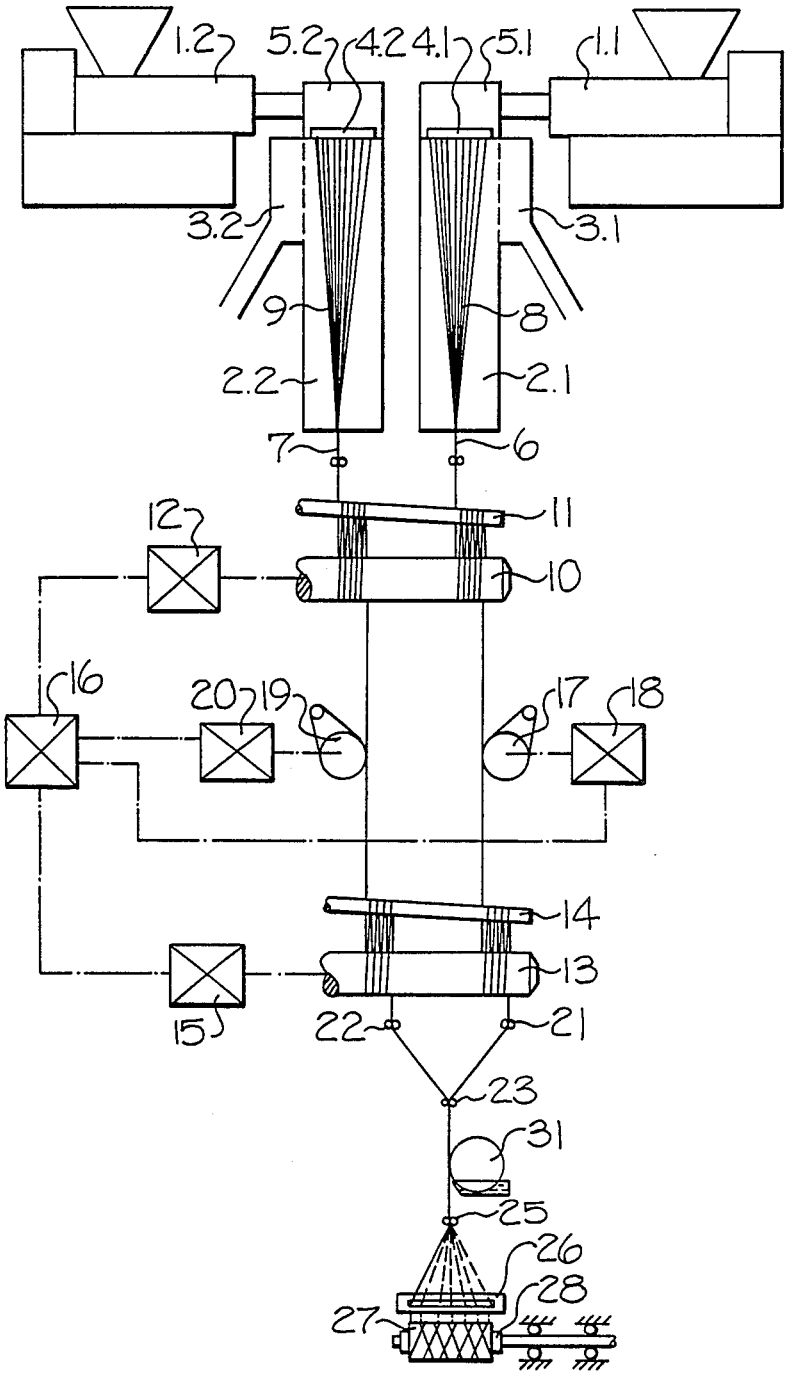
FIGS. 2, 3, and 4 are similar schematic views which illustrate other embodiments of the invention.

FIG. 2 illustrates an embodiment of the present invention wherein a yarn forming thermoplastic material is melted in two separate extruders 1.1 and 1.2, with one of the plastic materials being melt dyed. The two melts are spun through the nozzles 4.1 and 4.2 of the spin heads 5.1 and 5.2, to form the groups 8 and 9 of filaments. These filaments are cooled in the chambers 2.1 and 2.2 by means of an air blowing system 3.1 and 3.2, and then combined into yarn components 6 and 7. The yarn components are simultaneously withdrawn from the spinning nozzles 4.1 and 4.2 at a uniform speed by the delivery roll 10 and cooperating guide roll 11, with the motor 12 serving to drive the delivery roll 10.

The two yarn components 6 and 7 then advance along generally parallel paths of travel to a common draw roll 13 via the intermediate draw rolls 17 and 19. The roll 13 is driven by a motor 15 via a control system 16, which permits the separate adjustment of the speed of the drive motors 12 and 15, as well as the motors 18 and 20 which drive the draw rolls 17 and 19 respectively. From the draw roll 13, the yarn components 6 and 7 advance via the yarn guides 21 and 22 to the yarn guide 23, where they may be plied to form a composite yarn. The composite yarn is then wetted with a fluid by the yarn preparation roll 31, and it is then advanced via the yarn guide 25 to the traversing system 26 and takeup package 27.

In the embodiment of FIG. 2, it may be assumed that the dyeing of the melt slightly affects the physical properties of the melt, and the resulting solidified plastic in the filaments. For example, there is a probability that the shrinkage properties of the two yarn components will be different from each other. Such differences can be corrected or compensated for by the adjustment of the partial draw ratios, i.e., by the adjustment of the speed of the draw roll 17 with respect to the roll 19.

Figure 3:
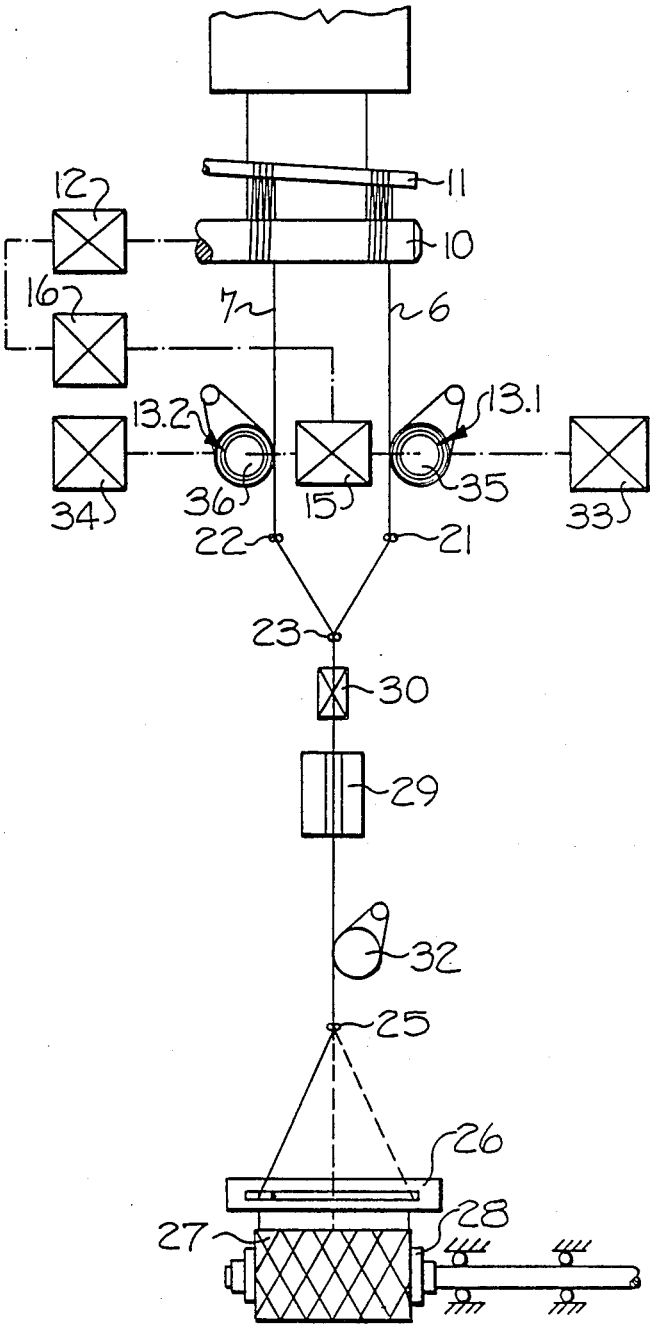

The embodiment illustrated in FIG. 3 is substantially similar to that of FIG. 1, with the filaments being melt spun and withdrawn by delivery roll 10 and guide roll 11. A motor 12 drives the drive roll 10. The two yarn components 6 and 7 are then drawn by respective draw rolls 13.1 and 13.2 which are driven by a common motor 15. The speed of the motor 15 and the speed of the motor 12 are adjusted by the control system 16 to have a predetermined ratio, which represents the total draw ratio. The draw rolls 13.1 and 13.2 are heated, for example by stationary induction coils 35 and 36, which are arranged in the iron casing of the draw rolls. The induction coils 35 and 36 are separately supplied with alternating current by regulators 33 and 34, and such that the temperature of the draw rolls 13.1 and 13.2 may be differently adjusted. The yarn components 6 and 7 are then again guided through the guides 21 and 22, and plied in the guide 23, and the resulting composite yarn is advanced through an entanglement nozzle 30 and heater 29. The yarn is withdrawn by means of a shrinkage roll 32, with the shrinkage roll 32 being driven at a speed which is less than the speed of the draw rolls 13.1 and 13.2, which enables the composite yarn to shrink. The yarn then advances via the yarn guide 25 and traversing system 26 to the takeup package 27, which is driven at a constant circumferential speed. In the embodiment of FIG. 3, a different shrinkage property is applied to the yarn components 6 and 7 by the different heating of the draw rolls 13.1 and 13.2. As a result, the yarn component with the lesser shrinkage tendency forms bows, loops and curls when shrinkage is effected, so that the composite yarn exhibits texturing.

Figure 4:
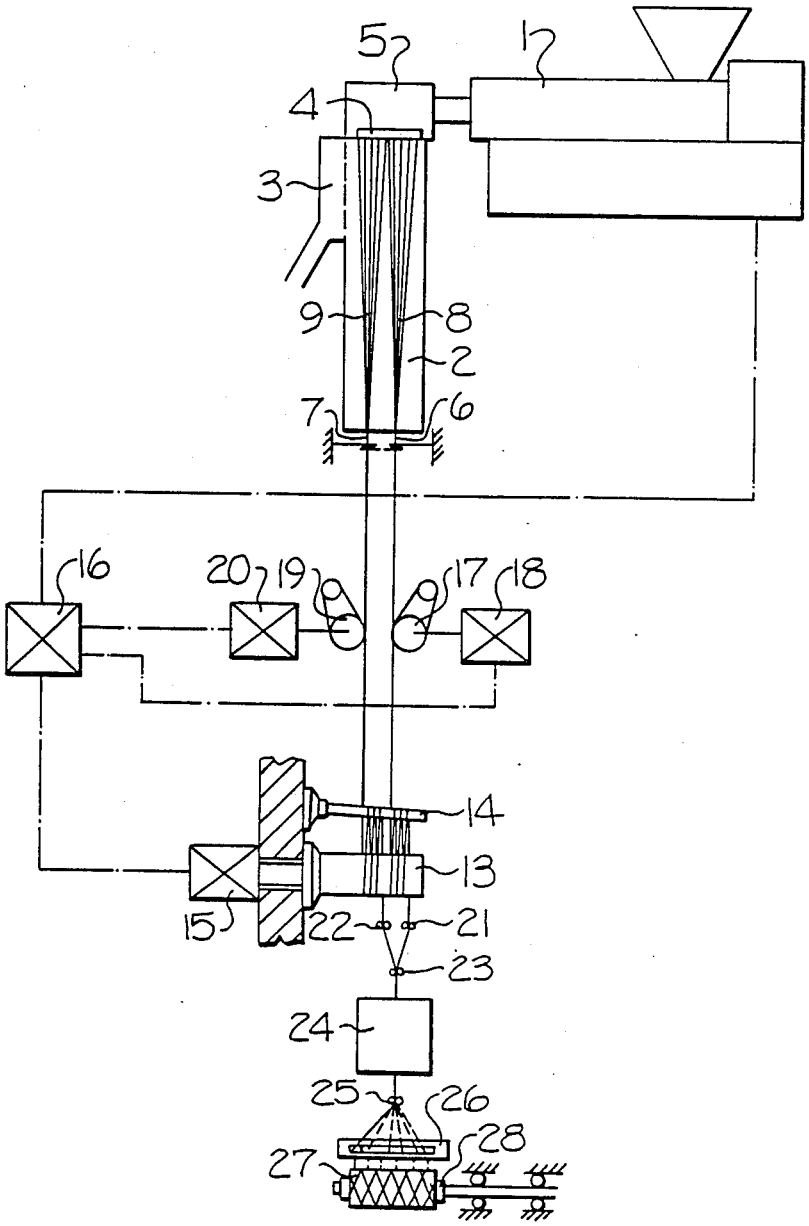

The embodiment of FIG. 4 illustrates an apparatus wherein a plurality of filaments are formed and guided into groups 8 and 9 in the manner described above with respect to FIG. 1, but the yarn components are withdrawn from the spinning nozzle 4 at different speeds by draw rolls 17 and 19. Each draw roll 17 or 19 is separately driven by the associated motor 18 and 20, and a common draw roll 13 is provided downstream so as to withdraw the yarn components 6 and 7 from the rolls 17 and 19. A guide roll 14 precedes the draw roll 13, with the components being looped several times around the rolls 13 and 14 without contacting each other. A motor 15 drives the draw roll 13, and both the drive motor 15 and the drive motor of the extruder 1 are interconnected via the control system 16 so as to permit a predetermined ratio between the delivered quantity of the melt, which is dependent on the speed of the extruder, and the speed of the common draw roll 13. The denier of the resulting composite yarn is thereby predetermined by this ratio. Also, since the ratio is identical for both yarn components 6 and 7, both yarn components also have the same denier thereafter. This applies where there is an identical number of filaments, and when the yarn components have differing numbers of filaments, all of the filaments will have the same individual denier. The control system 16 of FIG. 4 also controls the drive motors 18 and 20 for the draw rolls 17 and 19, so that the speed of these draw rolls can be differently adjusted, while remaining at a certain ratio to each other and to the speed of the extruder and the common draw roll 13.

The yarn components are withdrawn from the draw roll 13 via the yarn guides 21 and 22, and are plied in the yarn guide 23, and the resulting composite yarn may then advance through a special treatment system 24 as described above. Thereafter, the composite yarn is formed into a package in the manner described above.

In the embodiment of FIG. 4, the filaments which are produced will have an identical denier. However, since the filaments are withdrawn at different speeds from the spinning nozzle, a different shrinkage property will be imparted to the filaments. As a result, the filaments of the yarn component having a higher shrinkage tendency will contract in a subsequent shrinkage treatment to a greater extent than will the filaments of the other yarn component.

The following non-limiting specific examples further illustrate the present invention:

EXAMPLE 1

Two polypropylene filament yarn components of the same origin were drawn, at a total draw ratio of 1:3 in accordance with the embodiment of FIG. 1. Partial draw ratios of 1:1 and 1:3 were applied to the first yarn component, and partial draw ratios of 1:2.5 and 1:1.2 were applied to the second component yarn. Draw roll temperatures were as follows:

Draw roll 10: 70° C.
Draw rolls 17, 19: 110° C.
Draw roll 13: 110° C.

Shrinkage of the yarn components was effected by subjecting both components to hot air (130° C.) for 10 minutes, with the following results:

1st component yarn: 8% shrinkage
2nd component yarn: 13.5% shrinkage

EXAMPLE 2

Same as Example 1, however, the first component yarn was drawn at partial draw ratios of 1:1.5 and 1:2. Its shrinkage was then 8.5%.

EXAMPLE 3

Two polypropylene yarn components were produced in a process as shown in FIG. 3, with a total draw ratio of 1:3 and draw roll temperatures of 110° C. on draw roll 10; 110° C. on draw roll 13.1 for the first component yarn; and −70° C. on draw roll 13.2 for the second component yarn. The first component yarn had a shrinkage of 10% and the second component had a shrinkage of 16%.

In the drawings and specification there has been set forth preferred embodiments of the invention, and although specific terms are employed, they are used in a generic and descriptive sense only and not for purposes of limitation.

That which I claim is:

1. A method of making a composite yarn composed of polymeric filaments and comprising the steps of:

melt spinning polymeric material to form at least two separate groups of advancing filaments, passing the groups of filaments through a filament cooling zone immediately subsequent to the melt spinning step, drawing the groups of filaments subsequent to the cooling zone, said drawing step including advancing the groups of filaments through a drafting zone while imparting different speeds to the advancing groups at corresponding locations along their paths of travel in an advancing step through the drafting zone and imparting the same speed to the groups as they leave the drafting zone, and such that all of the groups of filaments have the same total draw ratio, and the physical properties of at least one of the groups of advancing filaments are modified with respect to the physical properties of another group of advancing filaments, combining the groups of modified filaments to form a composite yarn, and winding the composite yarn into a package.

2. The method as defined in claim 1, wherein the drawing step includes contacting each of the groups of filaments with a separate upstream draw roll and contacting all of the groups of filaments with a common downstream draw roll, and operating the upstream draw rolls at different speeds so that the speeds at which the groups are passed through the cooling zone and delivered to the drafting zone are different.

3. The method as defined in claim 1 wherein the groups of filaments are passed through said cooling zone at the same speed, and wherein the step of advancing the groups of filaments through the drafting zone includes drawing at least one of the groups of filaments in sequential steps along its path of travel, with the steps having different draw ratios, and such that the draw ratio applied to said at least one group of advancing filaments differs from the draw ratio applied to another of said groups of advancing filaments at corresponding locations along their paths of travel.

4. The method as defined in claim 1 wherein the groups of filaments are passed through said cooling zone at the same speed and wherein the step of advancing the groups of filaments through a drafting zone includes drawing each of the groups of filaments in sequential steps along its path of travel, with the steps of each group having different draw ratios, and such that the draw ratios applied to said one group of advancing filaments differs from the draw ratios applied to another group of advancing filaments at corresponding locations along their paths of travel.

5. The method as defined in claim 1 comprising the further step of applying heat to the composite yarn subsequent to the drawing step and prior to the winding step.

6. The method as defined in claim 1 comprising the further subsequent step of applying heat to heat shrink and texturing the composite yarn.

7. The method as defined in claim 1 wherein the melt spinning step includes spinning at least two separate groups of filaments having different shrinkage properties, and wherein the drawing step modifies the shrinkage properties of at least one of said groups in relation to the other of said groups so that the two groups have substantially the same shrinkage properties subsequent to the drawing step.

8. The method as defined in claim 1 wherein the melt spinning step includes spinning at least two separate groups of filaments having the same shrinkage properties, and wherein the drawing step modifies the shrinkage properties of one of said groups in relation to the other group so that the two groups have different shrinkage properties subsequent to the drawing step.

9. The method as defined in claim 1 wherein the step of combining the groups of advancing filaments includes plying the groups to form a composite yarn.

10. A method of making a composite yarn composed of polymeric filaments and comprising the steps of:

melting and extruding a polymeric material in a single extruder, melt spinning the extruded polymeric material by passing the same through a spinning nozzle to form a plurality of advancing filaments, separating the advancing filaments to form at least two separate groups of advancing filaments, passing the separated groups of filaments through a filament cooling zone immediately subsequent to the melt spinning step, drawing the groups of filaments subsequent to the cooling zone, said drawing step including advancing the groups of filaments through a drafting zone while imparting different speeds to the advancing groups at corresponding locations along their paths of travel in an advancing step through the drafting zone and imparting the same speed to the groups as they leave the drafting zone, and such that all of the groups of filaments have the same total draw ratio, and the physical properties of at least one of the groups of advancing filaments are modified with respect to the physical properties of another group of advancing filaments, combining the groups of modified filaments to form a composite yarn, and winding the composite yarn into a package.

11. The method as defined in claim 10 wherein the groups of filaments are passed through said cooling zone at the same speed, and wherein the step of advancing the groups of filaments through a drafting zone includes drawing each of the groups of filaments in sequential steps along its path of travel.

12. The method as defined in claim 10 wherein the drawing step includes contacting each of the groups of filaments with a separate upstream draw roll and contacting all of the groups of filaments with a common downstream draw roll, and operating the upstream draw rolls at different speeds so that the speeds at which the groups are passed through the cooling zone and delivered to the drafting zone are different.

* * * * *